US007188372B2

(12) United States Patent
Stockard

(10) Patent No.: US 7,188,372 B2
(45) Date of Patent: Mar. 13, 2007

(54) INFANT-SUPPORTING PRIVACY NURSING APRON

(76) Inventor: Ronna Stockard, P.O. Box 1495, Lorton, VA (US) 22199-1495

( * ) Notice: Subject to any disclaimer, the term of this patent is extended or adjusted under 35 U.S.C. 154(b) by 369 days.

(21) Appl. No.: 10/814,379

(22) Filed: Mar. 31, 2004

(65) Prior Publication Data

US 2004/0199977 A1 Oct. 14, 2004

Related U.S. Application Data

(60) Provisional application No. 60/461,826, filed on Apr. 11, 2003.

(51) Int. Cl.
*A41D 1/20* (2006.01)

(52) U.S. Cl. ..... 2/104; 2/48

(58) Field of Classification Search ..... 2/104, 2/48, 46, 51, 49.1–49.5, 52, 50, 102, 114, 2/88; 224/158, 159, 160; D3/214, 213; D2/860, 861, 862

See application file for complete search history.

(56) References Cited

U.S. PATENT DOCUMENTS

| | | | | | |
|---|---|---|---|---|---|
| 2,124,366 | A | * | 7/1938 | De Lasarte | 2/114 |
| D131,186 | S | * | 1/1942 | Kamholz | D2/864 |
| 2,567,524 | A | * | 9/1951 | Morganti | 2/48 |
| 2,597,948 | A | * | 5/1952 | Phillips | 224/575 |
| 3,587,952 | A | * | 6/1971 | Higuchi | 224/160 |
| D247,199 | S | * | 2/1978 | Carter | D3/214 |
| 4,106,122 | A | | 8/1978 | Dodd | |
| 4,166,558 | A | * | 9/1979 | Schroeder | 224/158 |
| D253,558 | S | * | 12/1979 | Carter | D3/214 |
| 4,469,259 | A | * | 9/1984 | Krich et al. | 224/160 |
| 4,579,264 | A | * | 4/1986 | Napolitano | 224/160 |
| 4,724,987 | A | * | 2/1988 | Maheu | 224/159 |
| 5,259,068 | A | | 11/1993 | Carroll | |
| 5,544,364 | A | | 8/1996 | Weber | |
| 5,592,692 | A | * | 1/1997 | Larson | 2/204 |
| 5,848,439 | A | | 12/1998 | Huseth | |
| D405,940 | S | | 2/1999 | Payne | |
| D425,696 | S | * | 5/2000 | Swanke | D3/213 |
| 6,182,873 | B1 | * | 2/2001 | Christopher et al. | 224/159 |
| 6,343,727 | B1 | * | 2/2002 | Leach | 224/158 |
| 6,434,750 | B1 | * | 8/2002 | Hunter | 2/88 |
| 6,536,047 | B1 | * | 3/2003 | Mullaly | 2/48 |

* cited by examiner

*Primary Examiner*—Amy B. Vanatta
(74) *Attorney, Agent, or Firm*—Dennis H. Lambert

(57) ABSTRACT

A nursing apron that covers an infant being breastfed to thereby afford privacy to the nursing mother, and that also provides at least partial support to the nursing infant. The apron is made from a piece of material having a top end, a bottom end, and opposite side edges, and is adapted to cover the chest area of a nursing mother, with the top end lying beneath the chin of the mother, the bottom end lying at about midsection of the mother, and the opposite side edges partially wrapping around the sides of the mother. A tie or belt is on the bottom end for securing the bottom end about the midsection of the mother to form a support pouch for supporting a nursing infant in position to be breastfed.

7 Claims, 3 Drawing Sheets

INFANT-SUPPORTING PRIVACY NURSING APRON

This application claims the benefit of U.S. Provisional Patent Application Ser. No. 60/461,826, filed Apr. 11, 2003.

TECHNICAL FIELD

This invention relates to cover garments for nursing mothers, and more particularly to a nursing apron that provides at least partial support to a nursing infant, and which has movable privacy flaps.

BACKGROUND ART

Many mothers breastfeed their infants. In order to obtain privacy, a nursing mother may seek out a location that is not occupied by other people. When this is not practical, the mother may drape a small blanket or other garment over the nursing infant. To avoid the necessity of draping a blanket over a nursing infant in order to obtain privacy, a variety of nursing garments have been designed in the prior art. U.S. Pat. Nos. 4,106,122, 5,544,364 and 5,848,439 are exemplary of such garments. The '364 and '439 patents both disclose cape-like garments that drape over the shoulders of the user, with '439 being split in the front and having viewing openings positioned over the breasts, and '364 essentially covering the entire front of the upper body and arms of the user. The '122 patent discloses an apron-like garment that drapes over the chest of the user and has a pair of flaps overlying openings through the apron in the area of the breasts. All of these prior art garments are completely open and loose at the bottom. They are essentially drapes that cover a nursing infant and the chest of a nursing mother to afford some privacy to the mother.

DISCLOSURE OF THE INVENTION

The present invention comprises a nursing apron that not only covers an infant being breastfed to thereby afford privacy to the nursing mother, but also provides at least partial support to the nursing infant.

The nursing apron of the invention comprises a piece of fabric having a length to extend from the neck of the user to about the waist, and a width at the top slightly narrower than the shoulders and a width at the bottom adapted to wrap around the front and sides of the midsection, whereby the apron covers the front of the upper body. An adjustable neck strap extends from the top end, and a neck pad is slidably mounted on the neck strap to distribute the weight of the infant and increase comfort during use. Securing means is attached to the bottom of the apron to secure the bottom snugly about the midsection of the mother so that the apron can support an infant during breastfeeding. A movable side flap on each side of the piece of fabric can be positioned to completely cover the nursing infant, or moved to partially expose the head of the infant while maintaining privacy to the mother.

In the specific embodiment described herein the piece of fabric is trapezoidal in shape, and the movable side flaps are attached to opposite sides between the top and bottom ends in the area of the breasts when the apron is being worn. The neck strap is a closed loop that comprises an extension of bands of fabric stitched along opposite sides of the piece of fabric, and the neck pad is slidable along the strap. The securing means can comprise any suitable means for securing the bottom of the apron around the midsection of the person wearing it, and in the example disclosed herein comprises a band of fabric stitched to the bottom of the apron and having a length such that its opposite ends can be wrapped snugly around the midsection of the mother and tied either in the back or the front to close the bottom of the apron and enable it to support an infant during nursing.

The apron preferably is made from a breathable fabric such as cotton or fleece, or other material that is machine-washable.

BRIEF DESCRIPTION OF THE DRAWINGS

The foregoing as well as other objects and advantages of the invention will become apparent from the following detailed description and accompanying drawings, wherein like reference characters designate like parts throughout the several views, and wherein.

DESCRIPTION OF THE PREFERRED EMBODIMENTS

Figure 1:
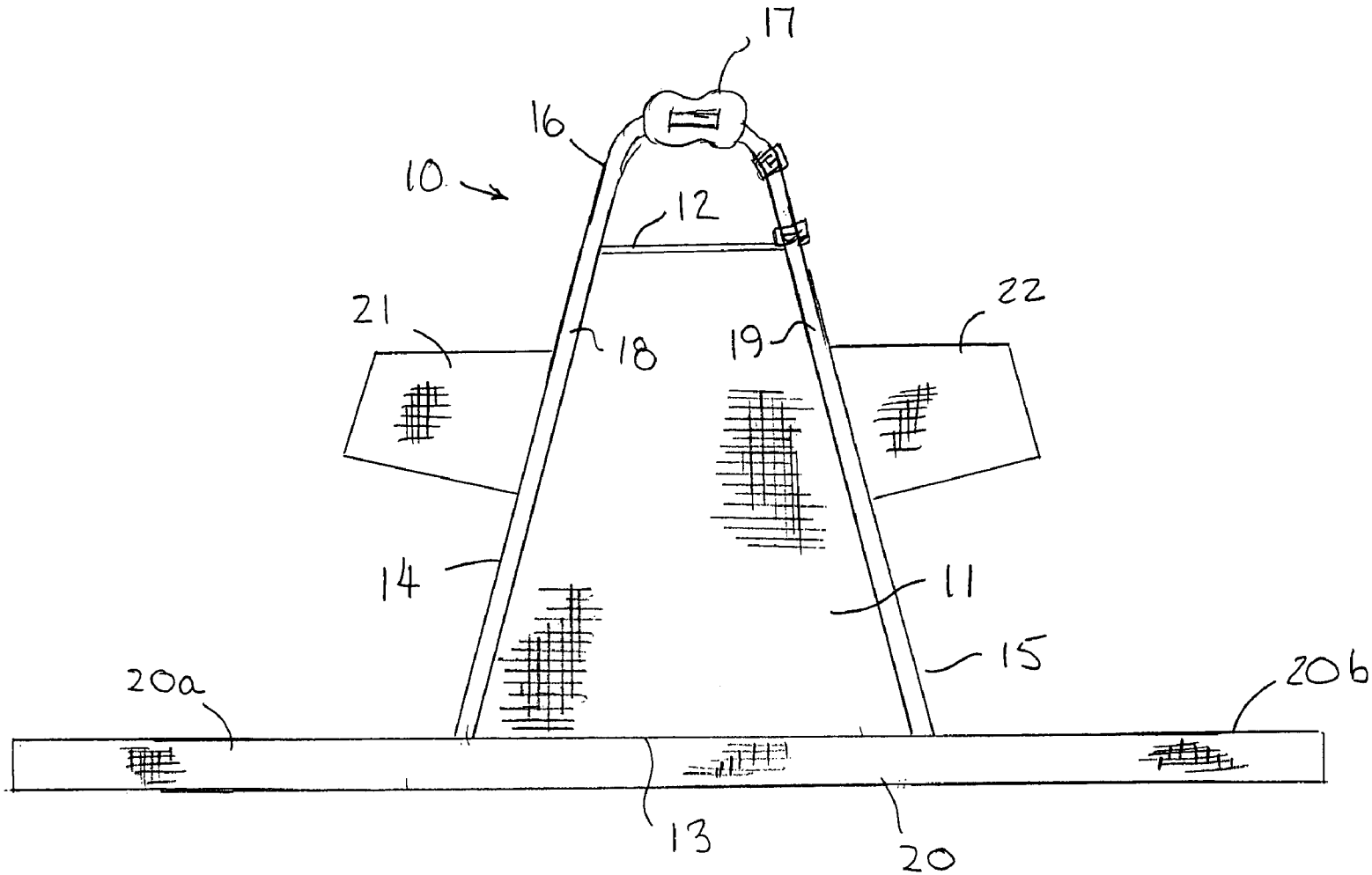
FIG. 1 is a plan view of the nursing apron of the invention, shown lying flat.

A nursing apron in accordance with the invention is indicated generally at 10 in FIGS. 1–5. The apron comprises a trapezoidal shaped piece of fabric 11 having a top end 12 with a first width preferably narrower than the shoulders of a person wearing the apron, a bottom end 13 having a second width greater than the first width and adapted to extend partially around the sides of the person's midsection, and sides 14 and 15 diverging from the top to the bottom end.

A neck strap 16 is attached to the top end for extending around the neck of the person wearing the apron, and a neck pad 17 is on the neck strap to distribute the weight of an infant held in the apron and increase comfort during use. The neck strap is adjustable in length and, in the particular embodiment described herein, comprises a continuation of strips of fabric 18 and 19 sewed along the opposite side edges of the apron. The neck pad is adjustable along the neck strap to adapt the strap and pad to optimally fit different individuals.

Figures 2, 3:
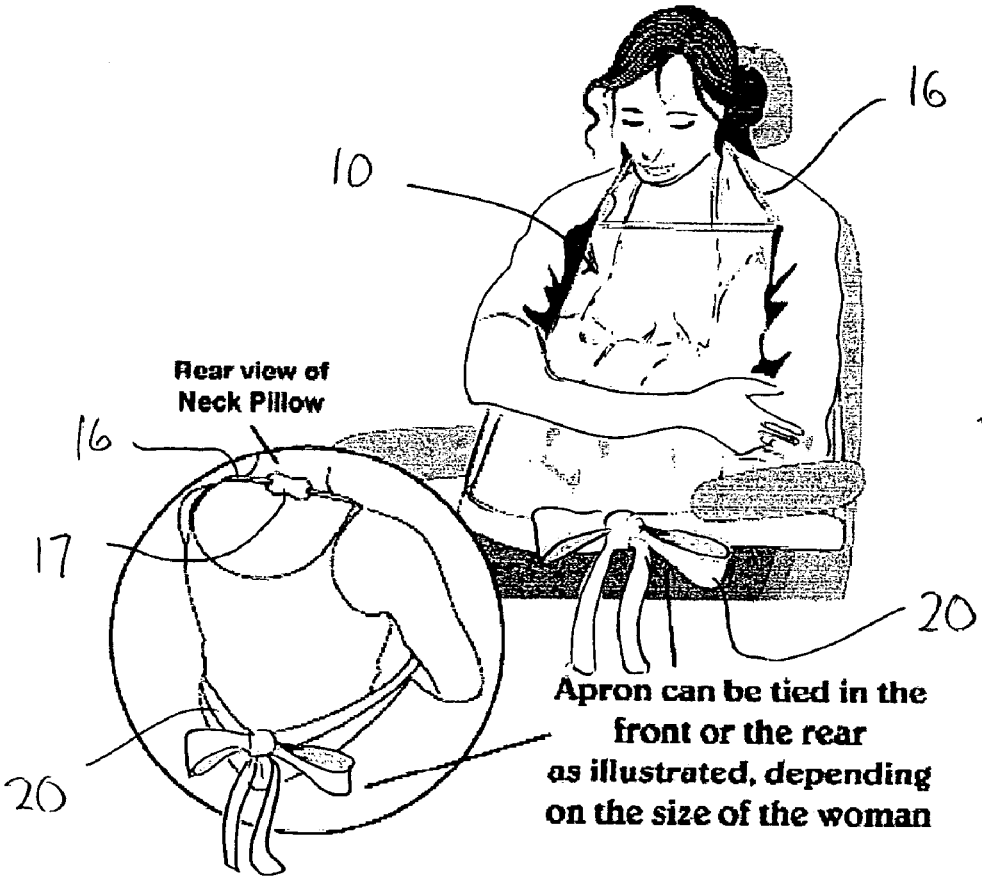
FIG. 2 is a front perspective view of the nursing apron in use, showing in broken lines the position of a nursing infant.
FIG. 3 is a fragmentary rear perspective view showing how the belt can be tied in the rear.

A securing means 20 is attached to the bottom end of the apron to snug the bottom end about the midsection of the person, and in the particular embodiment shown comprises an elongate strip of fabric stitched to the bottom end, with opposite ends 20*a*, 20*b* adapted to wrap around the midsection of the person, defining a belt that can be tied either in the front (FIGS. 2 and 4–5) or the back (FIG. 3). As can be seen in these figures, when the belt is tied around the midsection of the person the apron effectively forms a pouch that aids in supporting an infant while it is nursing.

Figure 5:
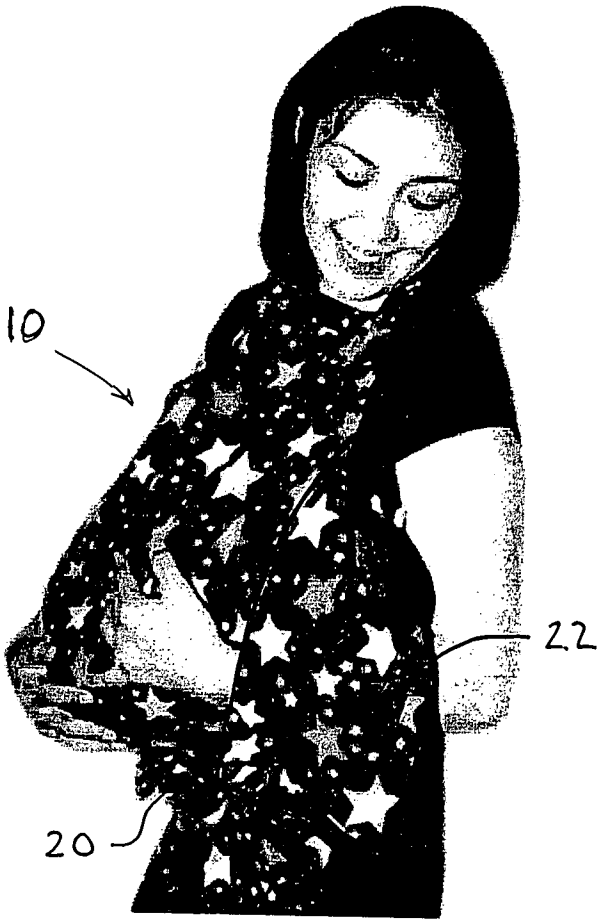
FIG. 5 is a front perspective view showing the apron in use with the side flap folded to an open position to at least partially expose the head of the nursing infant.
Figure 4:
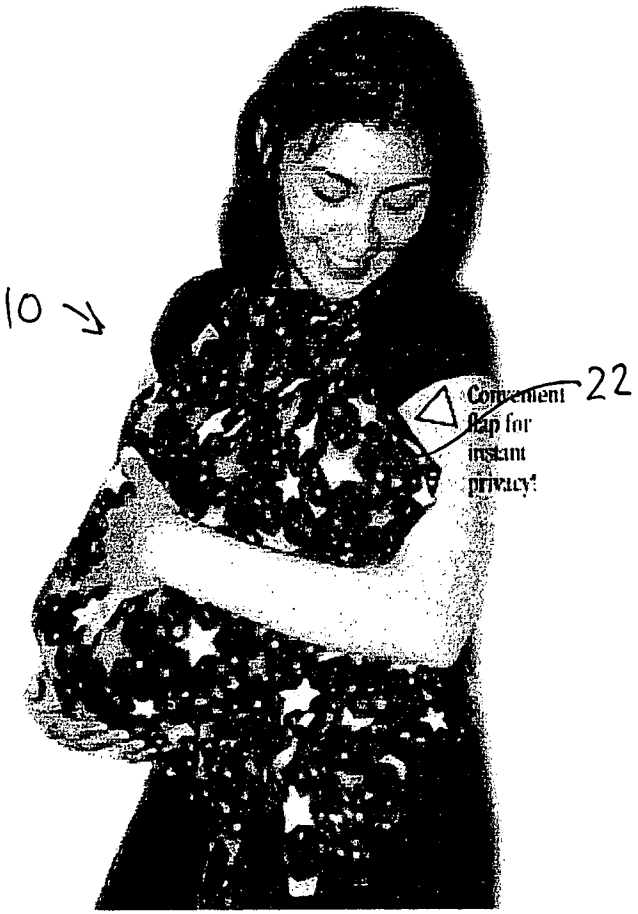
FIG. 4 is a front perspective view showing the apron in use with the side flap folded to overlie the nursing infant.

Flaps 21 and 22 sewed to opposite side edges of the apron between the top and bottom ends thereof in areas corresponding generally to the locations of the breasts can be folded over the infant's head for privacy as shown in FIG. 4, or folded to an open position so that the mother can observe the infant's head as shown in FIG. 5.

The apron preferably is made from a breathable fabric such as cotton or fleece, or other material that is machine-washable. The apron is easy to use, affords privacy, and can aid in supporting the infant while it is being breastfed.

Although particular embodiments of the invention are illustrated and described in detail herein, it is to be understood that various changes and modifications may be made to the invention without departing from the spirit and intent of the invention as defined by the scope of the appended claims.

What is claimed is:

1. A nursing apron for covering the chest area of a nursing mother to afford privacy to the mother while nursing an infant and for aiding in supporting the infant while it is nursing, comprising:

a generally trapezoidally shaped piece of washable material having a top end, a bottom end, and opposite side edges that taper inwardly from the bottom end toward the top end, and adapted to cover the chest area and breasts of a nursing mother, with the top end adapted to lie beneath the chin of the mother, the bottom end adapted to lie at about midsection of the mother, and the opposite side edges adapted to wrap partially around the sides of the mother;

securing means on the bottom end for securing the bottom end about the midsection of the mother to form a support pouch for receiving and covering an infant and aiding in supporting the infant in position to be breastfed;

a neck strap on the top end adapted to extend around the neck of a person wearing the apron to support the apron and an infant held therein;

the opposite side edges of the apron positioned so that the head of a nursing infant can be seen past a respective side edge; and privacy flaps on the opposite side edges of the apron for selectively covering or uncovering the head of an infant covered and supported by the apron.

2. A nursing apron as claimed in claim 1, wherein:

the securing means comprises an elongate strip of material attached to the bottom end of the apron, said strip of material having opposite ends extending beyond the side edges of the apron and adapted to wrap around the midsection of a person wearing the apron and be tied in front or back of the person.

3. A nursing apron as claimed in claim 1, wherein:

the neck strap is adjustable; and a neck pad is adjustably positioned on the neck strap to distribute the weight of an infant supported in the apron, increasing the comfort of use of the apron.

4. A nursing apron that covers an infant being breastfed to thereby afford privacy to a nursing mother, and provides at least partial support to the nursing infant, comprising:

a piece of washable fabric having a top end, a bottom end, and opposite side edges, and a length from the top end to the bottom end adapted to extend from the neck of the user to about the waist, and a width at the top end slightly narrower than the shoulders of a nursing mother using the apron and a width at the bottom end adapted to wrap around the front and sides of the midsection of the nursing mother, whereby the apron covers the front of the upper body of the nursing mother;

an adjustable neck strap extending from the top end for wrapping around the neck of a nursing mother using the apron, and a neck pad slidably mounted on the neck strap to distribute the weight of an infant supported in the apron;

securing means attached to the bottom end of the apron to secure the bottom end snugly about the midsection of the nursing mother and form a pouch to receive and support an infant during breastfeeding; and a movable side flap on each side edge of the piece of fabric, said side flaps positionable to cover the head of a nursing infant supported in the pouch, or movable to partially expose the head of the infant while maintaining privacy to the mother.

5. A nursing apron as claimed in claim 4, wherein:

the piece of fabric is trapezoidal in shape, and the movable side flaps are attached to the opposite side edges between the top and bottom ends in the area of the breasts of a person wearing the apron.

6. A nursing apron as claimed in claim 5, wherein:

the neck strap is a closed loop that comprises an extension of bands of fabric stitched along the opposite side edges of the piece of fabric.

7. A nursing apron as claimed in claim 6, wherein:

the securing means comprises a band of fabric stitched to the bottom end of the apron and having a length such that its opposite ends can be wrapped snugly around the midsection of the mother and tied either in the back or the front to close the bottom end of the apron and enable it to support an infant during nursing.

* * * * *